US005324005A

United States Patent [19]

Beattie et al.

[11] Patent Number: 5,324,005

[45] Date of Patent: Jun. 28, 1994

[54] LIFT ATTACHMENTS

[75] Inventors: John M. Beattie; Jimmie D. Sinden, both of Greeley, Colo.

[73] Assignee: Beattie Incorporated, Greeley, Colo.

[21] Appl. No.: 985,603

[22] Filed: Dec. 3, 1992

[51] Int. Cl.[5] ..... B66F 3/00

[52] U.S. Cl. ..... 254/134; 269/17

[58] Field of Search ..... 254/100, 133, 134; 269/17, 66–70, 296, 246, 249, 87–98

[56] References Cited

U.S. PATENT DOCUMENTS

| | | | |
|---|---|---|---|
| 1,812,585 | 6/1931 | Collins | 269/17 |
| 2,009,636 | 11/1937 | Weaver . | |
| 2,654,147 | 10/1953 | Wilson et al. | 269/17 |
| 2,895,712 | 7/1959 | Stovern et al. | 254/100 |
| 2,976,033 | 3/1961 | Martin | 269/17 |
| 2,997,292 | 8/1961 | Lucker et al. | 269/17 |
| 3,734,466 | 5/1973 | Mason . | |

*Primary Examiner*—Robert C. Watson
*Attorney, Agent, or Firm*—Dean P. Edmundson

[57] ABSTRACT

Lift attachment devices are described for detachably connecting an item to be lifted (e.g., a lawn mower) to lift apparatus (e.g., the type which includes an elevatable tool bar). The attachment devices each include a hanger for attaching the device to the tool bar and a clamp to detachably connect to the item to be lifted. The clamp support can be rotated relative to the hanger and then selectively locked in a desired position. The attachment devices enable a variety of items to be elevated by a conventional lift so that servicing and repair of the items can be performed efficiently. Lift apparatus is also described for connecting an item to be lifted to an elevatable tool bar.

12 Claims, 6 Drawing Sheets

LIFT ATTACHMENTS

FIELD OF THE INVENTION

This invention relates to lift attachments useful for lifting of equipment to enable inspection, servicing and repair. More particularly, this invention relates to clamping devices which are attachable to powered lift apparatus which is especially useful for lifting outdoor power equipment or the like.

BACKGROUND OF THE INVENTION

Golf course mowing equipment and other commercial mowing devices typically require frequent (e.g., daily) inspection, adjustment, servicing, or repair of various components. It is very difficult to access all of the components of the equipment without lifting the equipment or crawling under it. Conventional chain hoists are not suitable for lifting most types of power equipment because there normally aren't readily accessible portions of the frame to which several chains can be connected for lifting. Also, the equipment may not be stably supported with chains.

Conventional automobile hoists and lifts are also not adaptable to lifting equipment such as commercial mowers or various other types of equipment which do not have a frame which can be readily engaged by conventional hoist lifting arms. Conventional hoists or lifts do not include the types of adaptability which would be required in order to permit lifting of various types of power equipment. Those hoists which include arms which extend under a vehicle to be lifted require that the arms reach and engage the frame of the vehicle. Although this is possible when lifting conventional automobile vehicles, it is difficult or impossible to do this when attempting to lift various types of power equipment.

Furthermore, most types of power equipment such as commercial mowers or snowblowers cannot be easily attached to a conventional hoist or lift of the type intended for lifting automobiles. As a result, many types of power equipment (e.g., greens mowers) must either be serviced or repaired on the floor or they must be disassembled in order to enable various components to be accessed for servicing or repair.

Hoists, jacks and other types of apparatus have previously been used for various lifting purposes. See, for example, the hoists described in U.S. Pat. Nos. 2,099,636; 2,564,267; 3,734,466; 4,058,293; 4,196,887; and 4,856,618. Other lifting devices are also described in U.S. Pat. Nos. 4,793,593; 4,540,329; and 2,840,248.

None of such prior hoist and lifting devices are entirely suitable or practical for lifting and supporting odd-shaped vehicles and certain types of power equipment (e.g., greens mowers or snowblowers, etc.). Conventional lift apparatus either cannot engage items such as greens mowers, or the weight of the item is not properly balanced on the lift mechanism. This condition can be very dangerous because the item could slip or fall off the lift, causing damage to the item and injury to any workmen who may be under or near the item.

Some of the conventional hoist systems are also unsuitable because they include rails, platforms, or other lifting structure which extends underneath the item to be lifted. Such structure can interfere with required access to the underside of the item for inspection, servicing, or repair purposes.

Although ramps are sometimes used to support an item in an elevated position, this can be very dangerous. Also, the amount of elevation obtained with ramps is limited.

There have not heretofore been provided lift means which are suitable or practical for safely and efficiently lifting outdoor power equipment (e.g., greens mowers) to enable servicing and repair.

SUMMARY OF THE PRESENT INVENTION

In accordance with the present invention there is provided a lift attachment device which is especially useful for lifting equipment (e.g., greens mowers or snowblowers) to enable inspection, servicing and repair thereof. The attachment device is attachable to lift apparatus for lifting and supporting equipment such as commercial greens mowers and other types of outdoor power equipment which cannot be safely lifted and supported by means of conventional automobile hoist and lift attachment means.

In one embodiment of the invention there is provided a lift attachment device for detachably connecting an item to be lifted (e.g., a greens mower) to lift apparatus of the type which includes an elevatable tool bar, wherein the attachment device comprises:

(a) hanger means for attaching the device to the tool bar, (b) clamp means for detachable connection to the item to be lifted;

(c) pivot means between hanger means and the clamp means enabling the clamp means to rotate relative to the hanger means; and (d) lock means for selectively locking the pivot means to prevent rotation of the clamp means.

The lift attachment device enables an item of outdoor power equipment or the like to be safely lifted and then supported in an elevated position to enable servicing and repair operations to be conducted. The item can be rotated relative to the hanger so as to facilitate access and inspection of portions of the equipment which are not easily accessed when the equipment is resting on the floor.

The attachment devices of this invention are suitable for use in safe and effective lifting of a variety of items and power equipment (e.g., greens mowers, reel mowers, etc.). The attachment devices do not require access to wheels of the equipment in order to safely lift it. Also, there is no need to use chains or cables to attach to the item for lifting purposes.

Other advantages of the attachment devices of the invention will be apparent from the following detailed description.

The invention further provides lift apparatus for detachably connecting an item (e.g., a mower) to an elevatable tool bar. The apparatus comprises:

(a) support means;

(b) an elevational tool bar carried by the support means;

(c) pivot means attached to and supported by the tool bar;

(d) clamp means for detachable connection to the item to be lifted; wherein the clamp means is attached to the pivot means and is adapted to rotate relative to the tool bar; and (e) lock means for selectively locking the pivot means to prevent rotation of the clamp means.

This type of lift apparatus is especially useful for lifting a variety of items of outdoor power equipment or the like which are difficult to service or repair while they are on the floor.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
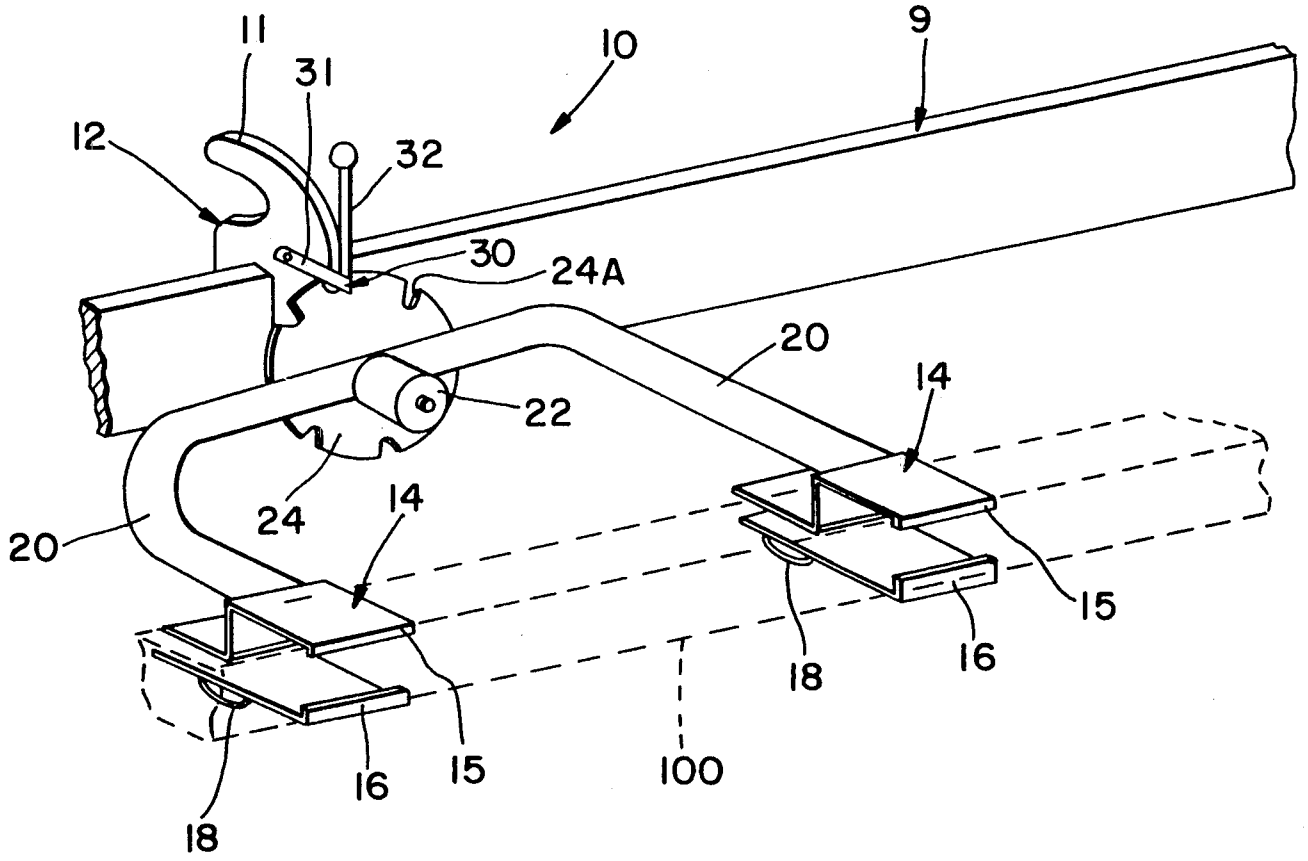
FIG. 1 is a perspective view illustrating one embodiment of lift attachment device of the invention.

In FIG. 1 there is illustrated one embodiment of attachment device 10 of the invention which is attached to or suspended from an elongated tool bar 9 of the type which is part of conventional lift apparatus. The tool bar is raised or lowered by means of a hydraulic cylinder, for example, in accordance with known techniques. The tool bar is typically disposed in a horizontal plane.

The attachment device 10 shown in FIG. 1 includes hanger means 12 for attachment to the tool bar 9 and clamp means 14 for detachable connection to the item 100 to be lifted (e.g., a transversely extending bar, rail, or frame section of a mower, snowblower, or the like). The clamp means are shown on the ends of arms 20 which are carried by a tubular hub 22. The hub is pivotably mounted on a shank extending outwardly from the hanger through disk 24. The disk is secured to the tubular hub 22.

The hub 22 can rotate relative to the hanger when the locking means 30 is raised or pivoted away from the disk 24. The locking means comprises an arm 31 which is pivotably connected to the hanger. Arm 32 which is secured to arm 31 may be urged toward the hanger to cause the arm 31 to be raised out of one of the peripheral notches 24A in disk 24. Then when it is desired to prevent further rotation of the clamping means and the disk, the arm 31 is lowered so as to engage a selected one of the notches 24A.

Rotation of the clamping means is very advantageous because it enables a greens mower or other item held by the clamps to be rotated to enable access to portions or components of the item which are not accessible when the item is on the floor. This feature is extremely advantageous because it facilitates access to the items for servicing and repair.

Figure 3:
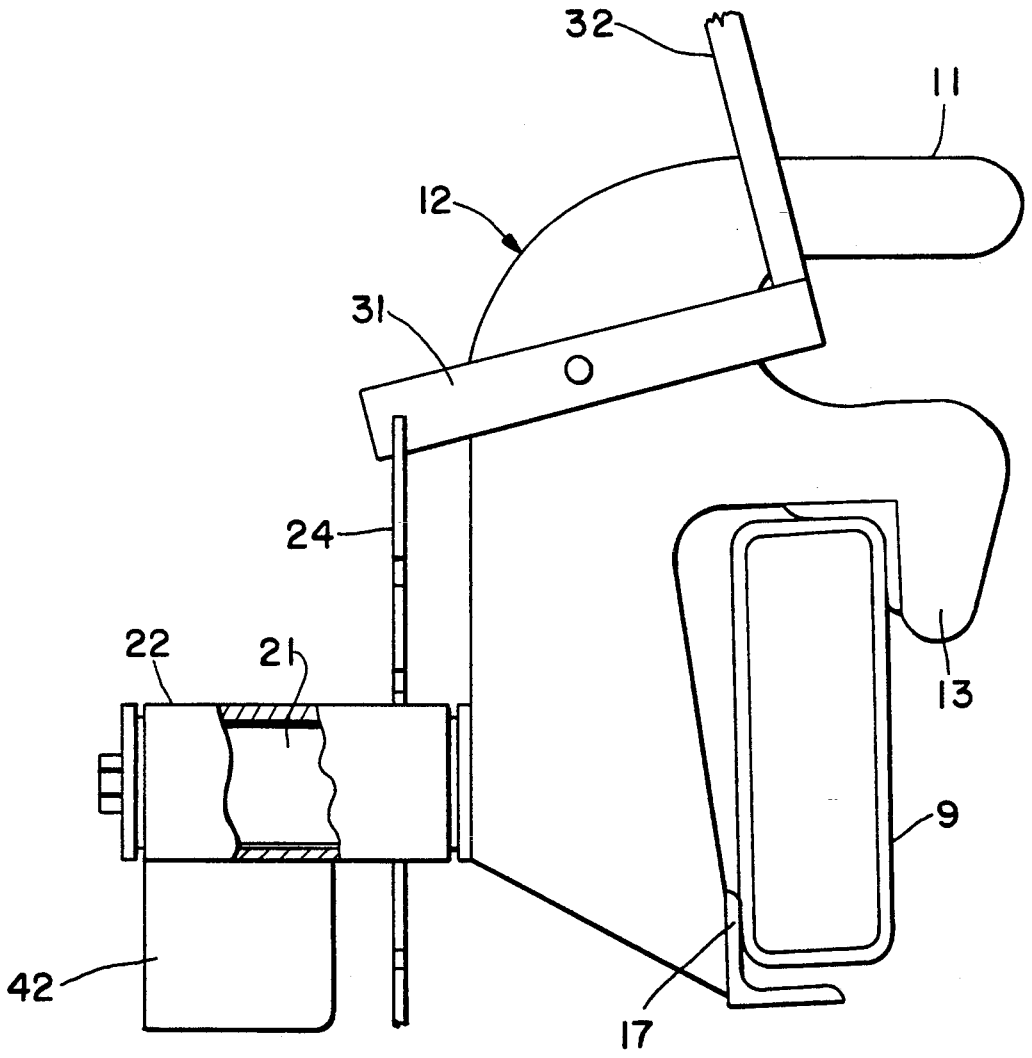
FIG. 3 is a side elevational view illustrating one embodiment of hanger means useful in lift attachment devices of this invention.

The attachment device 10 includes a handle portion 11 to facilitate carrying and handling of the attachment device. The hanger portion of the device preferably includes spaced-apart opposing arms 13 and 17 (as illustrated in FIG. 3) which are able to engage a tool bar in a manner such that angular rotation of the hanger relative to the tool bar is restricted in at least one direction. The hanger portion of the attachment device may be moved along the tool bar to any desired location prior to connecting the clamps to the item to be lifted. After the clamps have been secured to the item to be lifted, the downward force exerted on the hanger by the item being lifted prevents the hanger from being moved relative to the tool bar.

The tool bar shown has a rectangular cross-section and this is very common. Other shapes for the tool bar may also be used. A circular cross-sectional shape for the tool bar could also be used so long as the hanger is secured to it in a manner such that angular rotation in at least one direction is restricted. This is required so that the hanger does not rotate relative to the tool bar when an item is being lifted.

In the embodiment of attachment device shown in FIG. 1 the clamping means comprises opposing upper and lower fingers 15 and 16. A threaded bolt 18 passes through lower finger 16 and is engaged by a threaded aperture in arm 20. By rotating bolt 18 it is possible to draw finger 16 closer to upper finger 15 and thereby clamp or grip a transverse bar 100 of the item to be lifted. Preferably there are at least two such clamps and there may be more, if desired.

Figure 2:
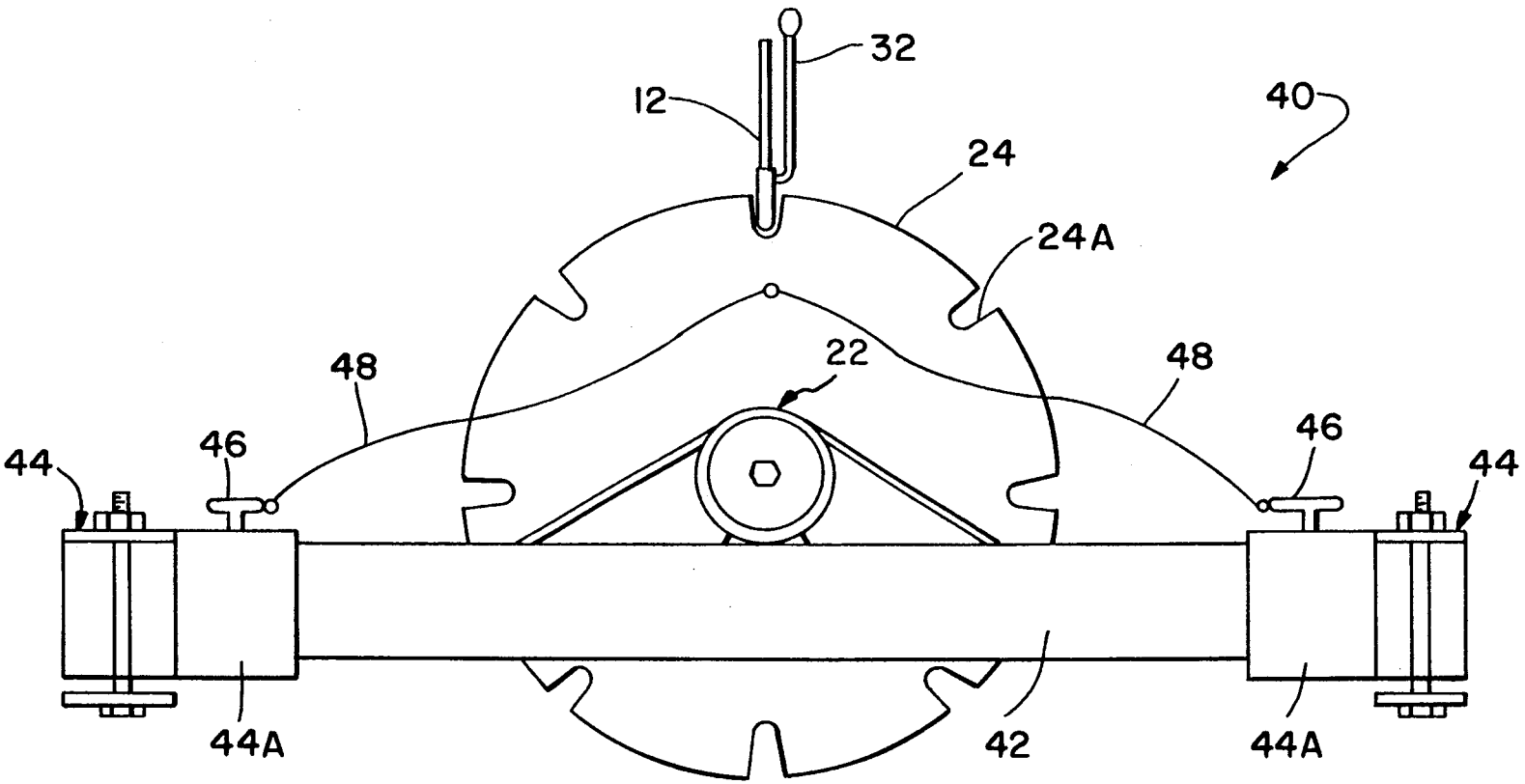
FIG. 2 is a front elevational view of another embodiment of lift attachment device of the invention.

FIG. 2 is a front elevational view of another embodiment of attachment device 40 of the invention attached to a horizontally disposed tool bar 9. In this embodiment an elongated bar 42 is secured to a tubular hub member 22 which is slidably received on a shank extending forwardly from the hanger. This is shown more clearly in the cut-away view of FIG. 3 where the shank 21 carried by the hanger can be seen.

Preferably a clamp 44 is carried by each end of the arm 42. Even more preferably, each clamp includes a tubular mounting portion 44A which is slidably received on the end of arm 42. A removable pin 46 is inserted through registering openings in portion 44A and arm 42 to retain each clamp in place. To prevent the pins 46 from being lost or misplaced, a cord 48 is connected between each pin and disk 24. This arrangement enables removal of clamps 44 and attachment of different types of clamps to the ends of arm 42. This is necessary when different types of clamps must be used to lift different items.

Figure 4:
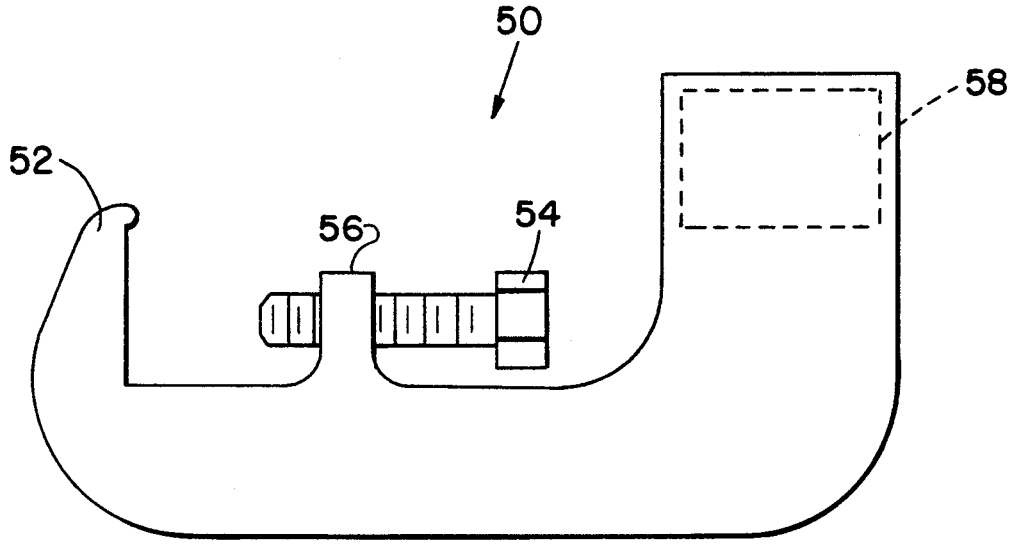
FIG. 4 is a side elevational view illustrating one embodiment of clamping means which is useful in the devices of the invention.

FIG. 4 is a side elevational view of another type of clamp means 50 which may be used in this invention. This type of clamp includes an upstanding finger member 52 and a threaded bolt 54 carried by upwardly extending support 56. By turning bolt 54 to move the bolt toward finger 52, an item to be lifted can be secured in the clamp. The clamp preferably includes a tubular portion 58 for slidably engaging one end of arm 42 of the attachment device.

Figure 5:
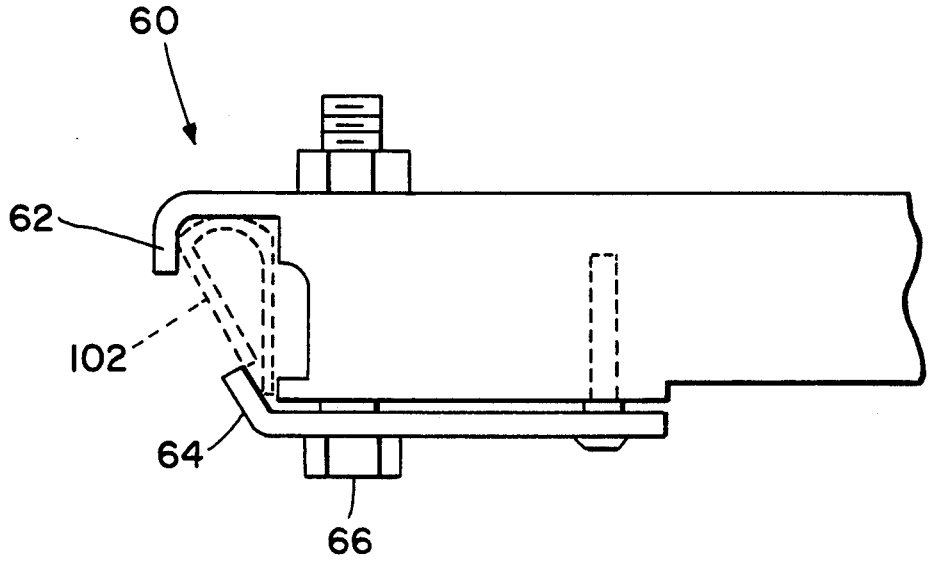
FIG. 5 is a side elevational view of another embodiment of clamping means which is useful in the devices of this invention.

FIG. 5 is a side elevational view of another type of clamp means 60 for gripping a rail or bar 102 of an item to be lifted. An upper finger portion 62 and a lower finger portion 64 can be drawn together by means of bolt 66.

Figure 6:
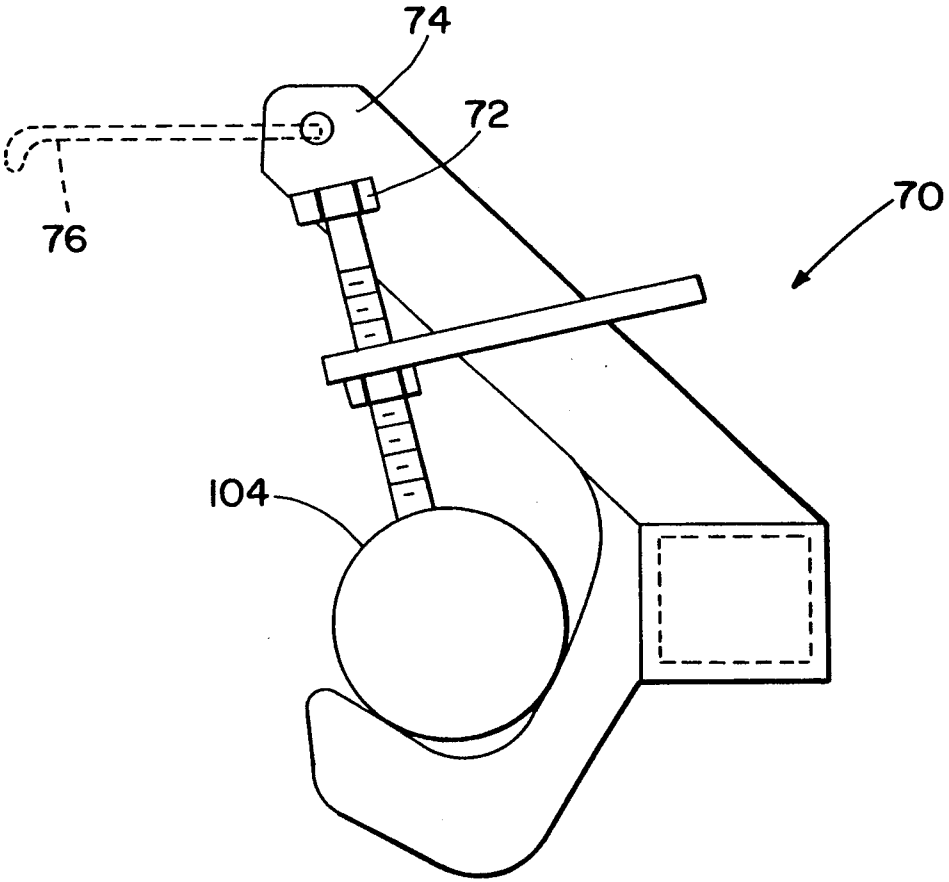
FIG. 6 is a side elevational view of yet another embodiment of clamping means which is useful in the devices of this invention.

FIG. 6 is a side elevational view of another type of clamp means 70 for gripping a bar or rail 104 of an item to be lifted. Bolt 72 can be tightened against rail 104 in the clamp. Link 76 carried by arm or bracket 74 is for attachment to another portion of the item to be lifted when the rail 104 is circular in cross-section.

Figure 7:
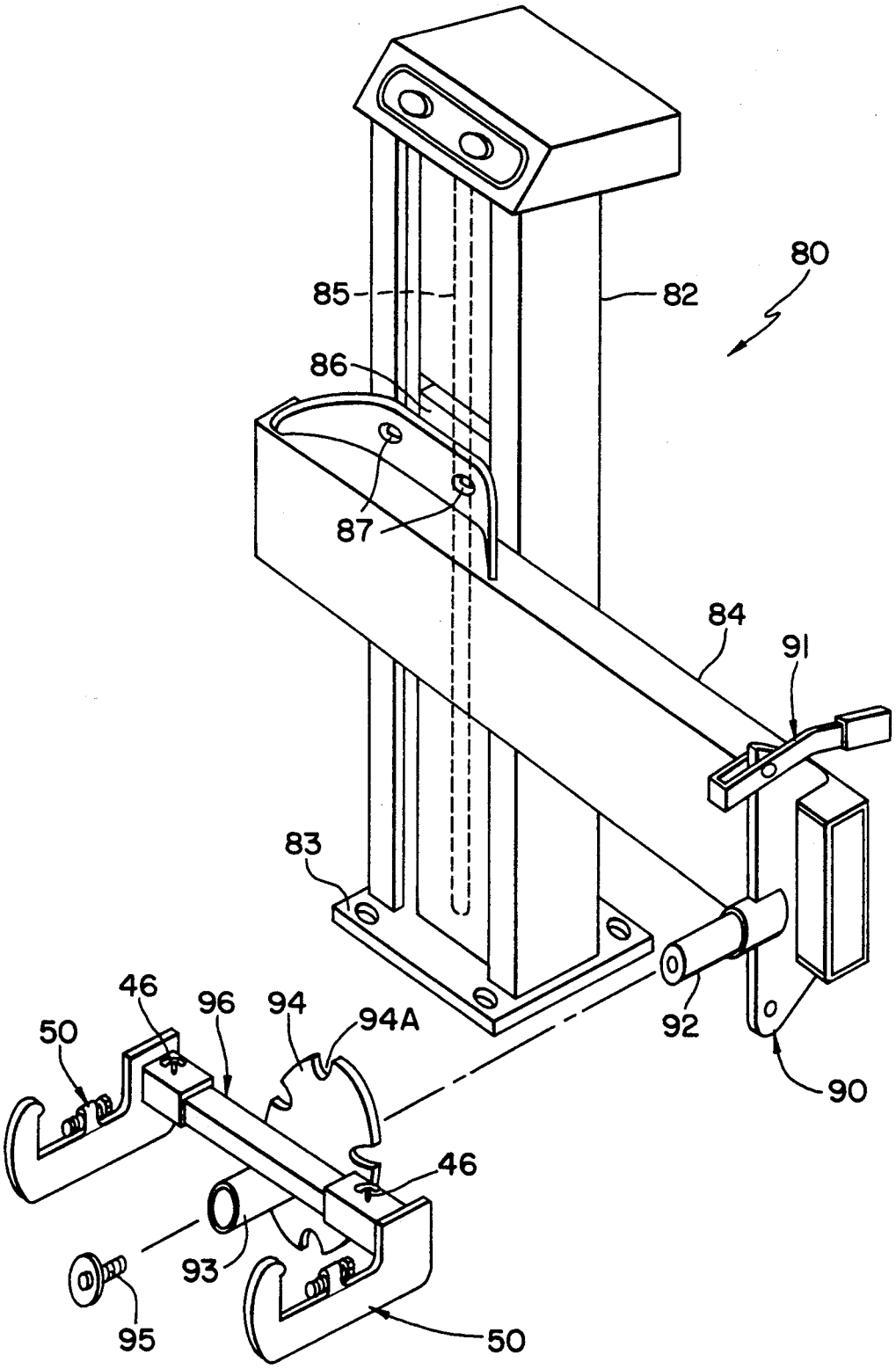
FIG. 7 is a perspective view showing one embodiment of lift apparatus of the invention.

In FIG. 7 there is shown one embodiment of lift apparatus 80 of the invention. This apparatus includes an upright support means 82 with base member 83. which can be bolted to a floor, for example. An elongated tool bar 84 is secured to a slide member 86 carried by the upright support 82. Bolts 87 can be used to attach the tool bar to the slide member. The slide member is threadably connected to vertical threaded shaft 85 within the upright support. The shaft 85 is operably connected to a gearbox powered by an electric motor, for example, for rotating the shaft to cause the tool bar to be selectively raised or lowered.

Secured to one end of the tool bar is a bracket 90 which includes an outwardly projecting shank 92. A tubular hub 93 is adapted to be slidably received on the shank and held in place by means of bolt 95. Secured to the hub 93 is a support arm 96 and a disk 94. The disk includes spaced peripheral notches 94A.

Attached to the outer ends of the support arm 96 are clamp members 50. Pins 46 are received in registering openings in the tubular mounting portion of the clamp and the support arm 96 to retain the clamps on arm 96.

When the tubular hub 93 is mounted on shank 92, the hub may be rotated to any desired angular position and then locked in position by means of lock arm 91 which is received in a desired notch 94A. Arm 91 is pivotably mounted on bracket 90.

In order to lift a desired item (such as a greens mower), the tool bar is lowered to the necessary height where the clamps are aligned with a transverse bar, rail or frame member of the mower. After the clamps have been secured to the transverse bar of the item to be lifted, the tool bar is elevated by activating the motor to rotate threaded shaft 85. The slide member 86 is consequently caused to be raised, thereby elevating the tool bar.

Other means for elevating a tool bar may be used, if desired. For example, a hydraulic cylinder may be used.

Other variants are possible without departing from the scope of this invention.

What is claimed is:

1. A lift attachment device for detachably connecting an item to be lifted to lift apparatus of the type which includes an elevatable tool bar, wherein said attachment device comprises:

(a) hanger means for attaching said device to said tool bar; wherein said hanger means comprises a body member comprising first and second opposing arms which are adapted to engage said tool bar in a manner such that angular rotation of said body relative to said tool bar is restricted in at least one direction;

(b) clamp means for detachable connection to said item to be lifted;

(c) pivot means between said hanger means and said clamp means enabling said clamp means to rotate relative to said hanger means; and (d) lock means for selectively locking said pivot means to prevent rotation of said clamp means.

2. A lift device in accordance with claim 1, further comprising an elongated support arm secured to said pivot means, and wherein said clamp means comprises a plurality of clamping members carried by said support arm.

3. A lift device in accordance with claim 2, wherein said clamping members are detachable from said support arm.

4. A lift device in accordance with claim 1, wherein said pivot means comprises a shank secured to said hanger means, and a tubular receiver which is adapted to rotate relative to said shank.

5. A lift device in accordance with claim 4, further comprising a disk member having a peripheral edge; wherein said peripheral edge includes a plurality of spaced notches; wherein said lock means comprises a latch arm carried by said hanger means; and wherein said latch arm is movable between a first position where said latch arm is received in one of said notches and a second position where said arm is free of said notches.

6. A lift device in accordance with claim 3, wherein said clamp members each comprise a tubular mounting portion which is adapted to be slidably received on said support arm.

7. A lift attachment device for detachably connecting an item to be lifted to lift apparatus of the type which includes an elevatable tool bar, wherein said attachment device comprises:

(a) hanger means for attaching said device to said tool bar; wherein said hanger means comprises a body member comprising first and second opposing arms which are adapted to engage said tool bar in a manner such that angular rotation of said body relative to said tool bar is restricted in at least one direction;

(b) clamp means for detachable connection to said item to be lifted; wherein said clamp means is rotatably mounted on said hanger means; and (c) lock means for selectively locking said clamp means to prevent rotation thereof.

8. A lift device in accordance with claim 7, wherein said clamp means comprises an elongated support arm and a plurality of clamping members carried by said support arm.

9. A lift device in accordance with claim 8, wherein said clamping members are detachable from said support arm.

10. A lift device in accordance with claim 7, further comprising a shank secured to said hanger means, and wherein said clamp means further includes a tubular receiver which is rotatably mounted on said shank.

11. A lift device in accordance with claim 8, further comprising a disk member having a peripheral edge; wherein said disk member is secured to said support arm; wherein said peripheral edge includes a plurality of spaced notches; wherein said lock means comprises a latch arm carried by said hanger means; and wherein said latch arm is movable between a first position where said latch arm is received in one of said notches and a second position where said arm is free of said notches.

12. A lift device in accordance with claim 9, wherein said clamp members each comprise a tubular mounting portion which is adapted to be slidably received on said support arm.

* * * * *